US007215087B2

(12) United States Patent
Matsushima

(10) Patent No.: US 7,215,087 B2
(45) Date of Patent: May 8, 2007

(54) DISCHARGE LAMP LIGHTING APPARATUS FOR LIGHTING MULTIPLE DISCHARGE LAMPS

(75) Inventor: Mitsuo Matsushima, Iwata-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 70 days.

(21) Appl. No.: 11/117,491

(22) Filed: Apr. 29, 2005

(65) Prior Publication Data

US 2006/0017403 A1 Jan. 26, 2006

(30) Foreign Application Priority Data

Jul. 9, 2004 (JP) ..... 2004-203316

(51) Int. Cl.
*H05B 41/16* (2006.01)

(52) U.S. Cl. ..... 315/274; 315/276; 315/279; 315/312; 315/291

(58) Field of Classification Search ..... 315/274, 315/276, 279, 280, 282, 286, 287, 312, 324, 315/316, 317, 323, 291, 307
See application file for complete search history.

(56) References Cited

U.S. PATENT DOCUMENTS 4,814,963 A * 3/1989 Petersen ..... 363/20
2002/0047556 A1 4/2002 Tajika et al.
2002/0125863 A1 9/2002 Lin et al.

FOREIGN PATENT DOCUMENTS

JP A 2002-015895 1/2002

* cited by examiner

*Primary Examiner*—Tuyet Thi Vo
(74) *Attorney, Agent, or Firm*—Oliff & Berridge, PLC

(57) ABSTRACT

In a discharge lamp lighting apparatus to light two discharge lamps, one terminal of the secondary side of a step-up transformer is connected, via each of two variable inductance elements, to one terminal of each of the two discharge lamps, the other terminal of each of the two discharge lamp is connected to one lamp current detecting unit connected to a lamp current control circuit, a switch is provided at the previous step of the lamp current control circuit, an output signal from one phase adjusting circuit is connected, via the switch, to the connection portion of the lamp current detecting unit and the lamp current control circuit, and the inductance of each variable inductance element is varied by an output signal which is sent from the lamp current control circuit, and which has a phase shifted from others, whereby the lamp current flowing through each discharge lamp is controlled.

10 Claims, 3 Drawing Sheets

DISCHARGE LAMP LIGHTING APPARATUS FOR LIGHTING MULTIPLE DISCHARGE LAMPS

BACKGROUND OF THE INVENTION

1. Field of the Invention

The present invention relates to a discharge lamp lighting apparatus, and more particularly to a discharge lamp lighting apparatus to light a plurality of discharge lamps for use as a backlight in a liquid crystal display (LCD) apparatus.

2. Description of the Related Art

An LCD apparatus, which is a flat panel display apparatus, is used in various applications. Since a liquid crystal in the LCD apparatus does not emit light by itself, a lighting device is required in order to achieve a good display. A backlight device to light a liquid crystal panel from behind is among such lighting devices. In the backlight device, a cold cathode lamp is mainly used as a discharge lamp, and a discharge lamp lighting apparatus including an inverter to drive the cold cathode lamp is provided.

Recently, the LCD apparatus is becoming larger and larger for use in, for example, a large-screen TV, and therefore a number of discharge lamps are used in a backlight device in order to achieve sufficient screen brightness for the LCD apparatus. Some backlight devices are provided with such a function as to variably control the brightness (luminance) of the discharge lamps depending on the environments. What is called "burst mode dimming method" is one of the brightness control methods. The burst mode dimming method operates such that driving power supply voltage is intermittently outputted so as to provide discharge lamps with on-periods and off-periods, and the ratio between the on-periods and off-periods which are defined by intermittent operation of high frequency current flowing through the discharge lamps is varied thereby controlling the time-average brightness.

In the burst mode dimming method, however, when a plurality of discharge lamps are intermittently lighted on and off simply by a prescribed output waveform, currents flowing in all the discharge lamps are switched on and off concurrently, and if this operation is repeated, then a current ripple of a switching power supply to apply a voltage increases, and consequently load current of the switching power supply must be increased thus causing cost increase on the switching power supply.

In order to deal with such a current ripple issue, what is called "a multi-phase discharge lamp lighting apparatus" is proposed, in which output phases of control circuits to control on/off operations of the discharge lamps are shifted from one another thereby controlling a ripple ratio (refer to, for example, Japanese Patent Application Laid-Open No. 2002-15895).

FIG. 3 is a block diagram for a circuitry of a discharge lamp lighting apparatus disclosed in the aforementioned Japanese Patent Application Laid-Open No. 2002-15895. The discharge lamp lighting apparatus shown in FIG. 3 is adapted to drive a plurality of cold cathode lamps 107, includes a timing signal generating circuit 103, and a plurality of dimming signal generating circuits 104 and switching circuits 105, which are provided respectively in a number equal to the number of resonant circuits 106 connected to respective cold cathode lamps 107, and operates such that the timing signal generating circuit 103 receives a PWM timing signal 101 and sequentially selects one dimming signal generating circuit 104 thereby sequentially turning on one cold cathode lamp 107 connected to the one dimming signal generating circuit 104 selected.

In the discharge lamp lighting apparatus shown in FIG. 3, a current ripple of a switching power supply can be suppressed by shifting on/off phases of the cold cathode lamps 107 from one another. However, since the dimming signal generating circuits 104 and the switching circuits 105 must be provided individually for each of the resonant circuits 106, a great number of control IC's and other components are required thus resulting in cost increase on the discharge lamp lighting apparatus.

SUMMARY OF THE INVENTION

The present invention has been made in light of the above problem, and it is an object of the present invention to provide a discharge lamp lighting apparatus, in which a multi-phase dimming method is achieved by a single control circuit thus requiring no additional circuit components and therefore resulting in cost reduction.

In order to achieve the object described above, according to an aspect of the present invention, there is provided a discharge lamp lighting apparatus which comprises: a first DC power supply; a control circuit; a step-up transformer defining a primary side and a secondary side; and switching elements which is connected to the first DC power supply, and which drives the primary side of the step-up transformer by a signal from the control circuit thereby lighting at least two discharge lamps provided at the secondary side of the step-up transformer. In the discharge lamp lighting apparatus described above, one terminal of the secondary side of the step-up transformer is connected, via each of at least two variable inductance elements, to one terminal of each of the discharge lamps, and the other terminal of the secondary side of the step-up transformer is grounded; at least two series resonant circuits are each formed by a leakage inductance of the step-up transformer, an inductance of each variable inductance element, and capacitors provided between each variable inductance element and each discharge lamp; at least two lamp current detecting units are each provided at the other terminal of each discharge lamp, and a signal of each of the lamp current detecting units is connected to each of at least two lamp current control circuits; a phase adjusting circuit is connected to at least two switches each of which is connected to a connecting node between each lamp current detecting unit and each lamp current control circuit; each of the at least two switches is turned on and off according to an output signal from the phase adjusting circuit; and an output signal sent from each lamp current control circuit and having a phase shifted from others is connected to each variable inductance element so as to vary the inductance of each variable inductance element, whereby a lamp current flowing through each discharge lamp is controlled.

In the aspect of the present invention, each of the lamp current control circuits may include an operational amplifier and a transistor, a signal from each of the lamp current detecting units and a reference voltage may be inputted to the operational amplifier, an output of the operational amplifier may be connected to the base terminal of the transistor, and the collector terminal of the transistor may be connected to each of the variable inductance elements thereby varying the inductance of each variable inductance element.

In the aspect of the present invention, each of the variable inductance elements may constitute a transformer, and a snubber circuit may be connected to the both terminals of a control winding of the transformer.

In the aspect of the present invention, the discharge lamp lighting apparatus may be incorporated in a backlight device for a liquid crystal display apparatus.

According to the present invention, the currents flowing through the plurality of the discharge lamps are equalized thereby reducing the variation in brightness between the discharge lamps, and this can be achieved by using a limited number of additional circuit components with a high withstand voltage thus providing an inexpensive discharge lamp lighting apparatus.

Also, the lamp current can be controlled by the leakage inductance present at the step-up transformer and the variable inductance element, which results in downsizing.

And, since the signal of the phase adjusting circuit is connected to the connection portion of the lamp current detecting unit and the lamp current control circuit, and the phases of respective lamp currents are shifted from one another, current ripple resulting from rise timing of output waveform can be duly suppressed without providing several inverter circuits and control circuits for the discharge lamps.

DETAILED DESCRIPTION OF THE PREFERRED EMBODIMENTS

Preferred embodiments of the present invention will hereinafter be described with reference to the accompanying drawings.

Figure 1:
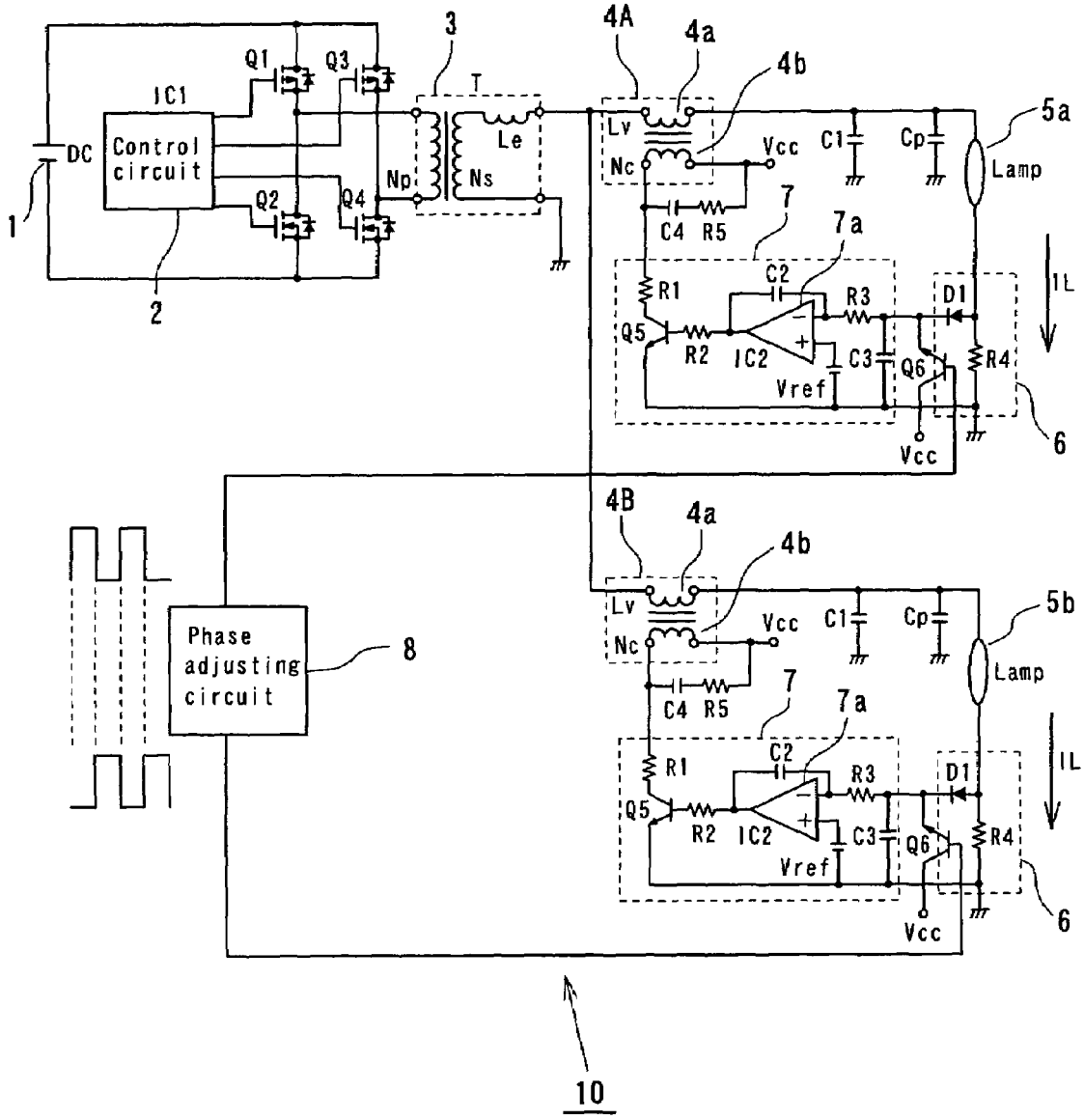
FIG. 1 is a circuitry of a discharge lamp lighting apparatus according to a first embodiment of the present invention.

Referring to FIG. 1, a discharge lamp lighting apparatus 10 according to a first embodiment is adapted to light a plurality (two in the figure) of discharge lamps 5*a* and 5*b*. In the discharge lamp lighting apparatus 10, a series circuit consisting of transistors Q1 and Q2 as switching elements and a series circuit consisting of transistors Q3 and Q4 are connected in parallel to a first DC power supply 1, and the connection portion of the transistors Q1 and Q2 and the connection portion of the transistors Q3 and Q4 are connected respectively to both terminals of a primary winding Np of a step-up transformer 3, whereby what is called a full-bridge is constituted.

A control circuit 2 controls the discharge lamp lighting apparatus 10 and includes an oscillation circuit to set a driving frequency for driving the primary side of the step-up transformer 3, and the transistors Q1, Q2, Q3 and Q4 are switched on and off at a predetermined timing by output signals from the control circuit 2 thereby generating an AC voltage. The driving frequency is set to be higher than a resonant frequency of a series resonant circuit (to be described later) formed at the secondary side of the step-up transformer 3.

The primary side of the step-up transformer 3 is connected to the above-described full-bridge constituted by the transistors Q1, Q2, Q3 and Q4 in the present embodiment, but may alternatively be connected to a half-bridge. The full-bridge performs a switching operation more efficiently than the half-bridge and therefore is more preferable.

One terminal of a secondary winding Ns of the step-up transformer 3 is connected to one terminals of the discharge lamps 5*a* and 5*b* via respective windings 4*a* of transformers 4A and 4B as variable inductance elements, and the other terminal of the secondary winding Ns of the step-up transformer 3 is grounded. Further description on the circuitry will be made with reference to a circuit including the discharge lamp 5*a*.

At the secondary side of the step-up transformer 3, the aforementioned series resonant circuit is formed by a leakage inductance Le of the step-up transformer 3, an inductance Lv of the transformer 4A, and capacitors C1 and Cp. The capacitor C1 is a capacitor connected to the circuit and adapted to adjust resonant frequency, and the capacitor Cp is a stray capacitance.

A lamp current detecting unit 6 is provided at the other terminal of the discharge lamp 5*a*. The lamp current detecting unit 6 consists of a lamp current detecting resistor R4 and a rectifier diode D1, and a lamp current IL flowing through the discharge lamp 5*a* is converted by the lamp current detecting resistor R4 into a voltage, which is rectified by the rectifier diode D1 connected to the connection portion of the discharge lamp 5*a* and the lamp current detecting resistor R4 and which is outputted to the inverting input terminal of an operational amplifier 7*a* constituting a lamp current control circuit 7.

A reference voltage Vref is inputted to the non-inverting input terminal of the operational amplifier 7*a*, the voltage rectified by the rectifier diode D1 is compared to the reference voltage Vref, and a resulting output is applied to the base of a transistor Q5. The collector terminal of the transistor Q5 is connected to a control winding 4*b* of the transformer 4A, and the inductance value of the transformer 4A is controlled by fluctuation of the collector current of the transistor Q5, which fluctuates according to the output voltage of the operational amplifier 7*a*, that is to say, by fluctuation of a current flowing through the control winding 4*b*. The inductance value of the transformer 4A decreases when the current value of the control winding 4*b* increases. A snubber circuit, which consists of a capacitor C4 and a resistor R5 connected in series to each other, is connected in parallel to the control winding 4*b* of the transformer 4A in order to protect against a high spike voltage at the time of generation of back electromotive force.

The normal brightness control operation of the discharge lamp lighting apparatus 10 according to the present embodiment will be explained on the assumption that there is no output signal from a phase adjusting circuit 8.

When the lamp current IL flowing through the discharge lamp 5*a* comes down below a predetermined value, the voltage of the lamp current detecting resistor R4 decreases. As a result, the output voltage of the operational amplifier 7*a* steps up, and the base current of the transistor Q5 increases causing the collector current to increase, too. Consequently, a current flowing through the control winding 4*b* of the transformer 4A increases causing the inductance value of the transformer 4A as a variable inductance element to decrease, and the resonant frequency $f_0$ ($f_0=\frac{1}{2}\pi\sqrt{(Le+Lv)\times(C1+Cp)}$) of the resonant circuit formed at the secondary side of the step-up transformer 3 increases so as to come closer to the driving frequency at the primary side of the step-up transformer 3, which is set higher than the resonant frequency $f_0$ as described above, resulting in that the impedance of the resonant circuit at the driving frequency is lowered, and that the lamp current IL flowing through the discharge lamp 5*a* increases.

On the other hand, when the lamp current IL flowing through the discharge lamp 5*a* comes up above the aforementioned predetermined value, the voltage of the lamp current detecting resistor R4 increases. As a result, the output voltage of the operational amplifier 7*a* steps down, and the base current of the transistor Q5 decreases causing the collector current to decrease, too. Consequently, a current flowing through the control winding 4*b* of the transformer 4A decreases causing the inductance value of the transformer 4A as a variable inductance element to increase, and the resonant frequency $f_0$ of the resonant circuit at the secondary side of the step-up transformer 3 decreases so as to get away from the driving frequency at the primary side of the step-up transformer 3, which is set higher than the resonant frequency $f_0$, resulting in that the impedance of the resonant circuit at the driving frequency is raised, and that the lamp current IL flowing through the discharge lamp 5*a* decreases.

A circuitry which includes the discharge lamp 5*b*, and which is connected in parallel to the secondary winding Ns of the step-up transformer 3 is identical with the above-described circuitry including the discharge lamp 5*a*. The action of a lamp current IL flowing through the discharge lamp 5*b* is the same as the action of the lamp current IL flowing through the discharge lamp 5*a*, the operation of the transformer 4B as a variable inductance element is the same as the operation of the transformer 4A, and therefore their explanations will be omitted.

In the present embodiment, the burst mode dimming method based on the intermittent on/off operations of the discharge lamps is performed by switching on and off a switch Q6 according to an output signal from the phase adjusting circuit 8. For this reason, the output from the phase adjusting circuit 8 is connected, via the switch Q6, to the connection portion of the lamp current detecting unit 6 and the lamp current control circuit 7, and in the present embodiment, the output from the phase adjusting circuit 8 is connected to the base terminal of the switch Q6 which is constituted by an NPN transistor while the collector terminal and the emitter terminal of the switch Q6 are connected respectively to a second DC power supply Vcc (>Vref), and the connection portion of the rectifier diode D1 and an input resistor R3 as an inverting input terminal of the operational amplifier 7*a*.

The operation of the burst mode dimming method bases on the circuitry described above will be explained.

When the output signal from the phase adjusting circuit 8 is at a low level with the switch Q6 switched off, a current corresponding to the reference voltage Vref predetermined flows through the control winding 4*b* of the transformer 4A, and the discharge lamp 5*a* is lighted by the predetermined lamp current IL maintained at a predetermined value under the normal brightness adjustment described above. On the other hand, when the output signal from the phase adjusting circuit 8 is at a high level causing the switch Q6 to be switched on, an input voltage at the inverting input terminal of the operational amplifier 7*a* is fixed at Vcc (>Vref). As a result, the transistor Q5 is turned off regardless of the output voltage from the lamp current detecting unit 6, and current does not flow through the control winding 4*b* of the transformer 4A. Consequently, the inductance value of the transformer 4A increases, and the discharge lamp 5*a* cannot keep carrying out discharge operation and goes off.

The on/off control by the phase adjusting circuit 8 is performed in the same way also at the circuit including the discharge lamp 5*b* and the transformer 4B as a variable inductance element. The waveform of the output signal from the phase adjusting circuit 8 is shifted in phase between the circuits including the discharge lamps 5*a* and 5*b*, respectively, and the discharge lamps 5*a* and 5*b* are driven by the multi-phase method such that the phases of the lamp currents IL flowing intermittently through respective discharge lamps 5*a* and 5*b* are shifted from each other. In this way, the rise timing of the output waveform is prevented from overlapping so as to enlarge current ripple. Thus, since lamp currents flowing through a plurality of discharge lamps are controlled individually per discharge lamp, the lamp currents can be equalized resulting in reduced brightness variation between the discharge lamps. Also, since the output signal of the phase adjusting circuit 8 is provided between the lamp current detecting unit 6 disposed at the low tension side of the discharge lamp and the phase adjusting circuit 8, the burst mode dimming method can be performed by switching on and off the switch Q6, and also the multi-phase method is enabled by only one control circuit 2.

In the present embodiment, the discharge lamp lighting apparatus 10 shown in FIG. 1 is to light two discharge lamps as an example, but can light more than two discharge lamps only if additional circuits each including a discharge lamp are connected in parallel at the secondary side of the step-up transformer 3. Also, the switch Q6 may be constituted by a PNP transistor, and the output from the phase adjusting circuit 8 may be connected to the base terminal of the switch Q6 while the emitter terminal and the collector terminal of the switch Q6 are connected respectively to the second DC power supply Vcc (>Vref), and the connection portion of the rectifier diode D1 and the input resistor R3 as an inverting input terminal of the operational amplifier 7*a*. In such an arrangement, the switch Q6 turns on when the output signal from the phase adjusting circuit 8 is at a low level, and turns off when the output signal is at a high level, whereby the burst mode dimming method described above is duly performed.

Figure 2:
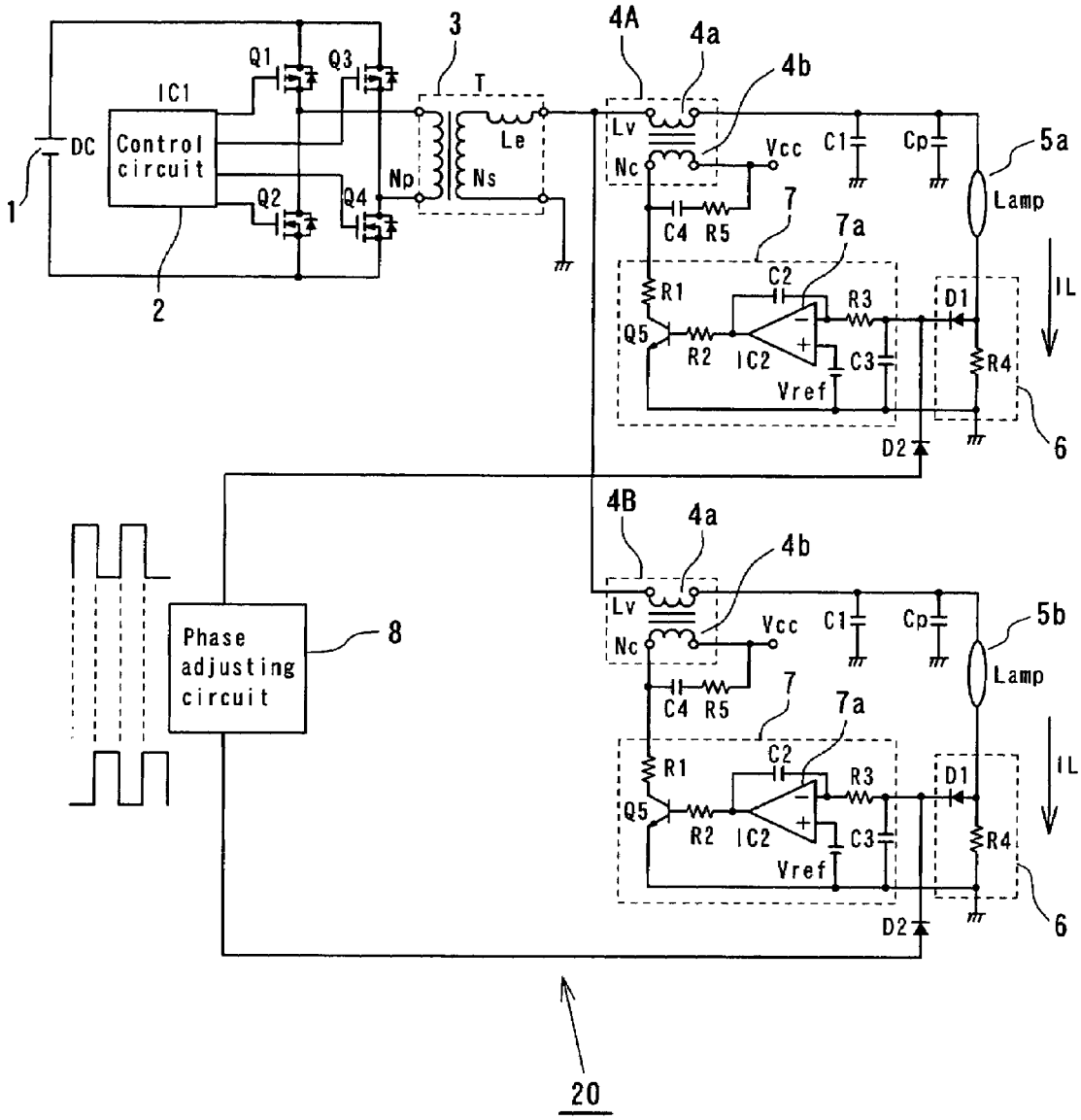
FIG. 2 is a circuitry of a discharge lamp lighting apparatus according to a second embodiment of the present invention.
Figure 3:
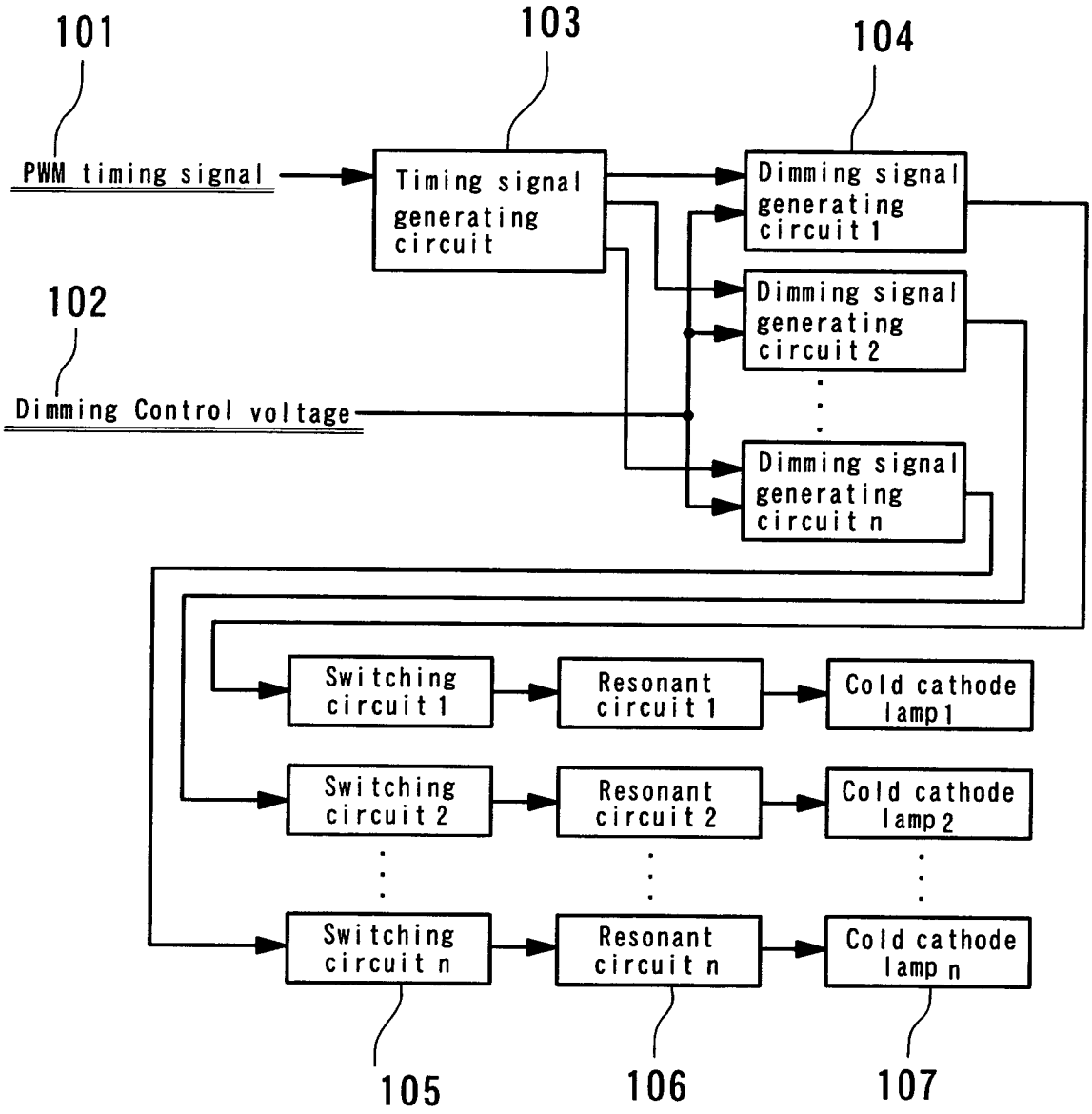
FIG. 3 is a block diagram for a conventional multi-phase discharge lamp lighting apparatus.

FIG. 2 shows a discharge lamp lighting apparatus 20 according to a second embodiment of the present invention. The discharge lamp lighting apparatus 20 operates in the same way as the discharge lamp lighting apparatus 10 shown in FIG. 1, and therefore description will be focused on its difference therefrom.

In the second embodiment, the burst mode dimming method by the multi-phase method is performed by switching on and off a switch D2 according to an output signal from a phase adjusting circuit 8 which has its output connected, via the switch D2, to the connection portion of a lamp current detecting unit 6 and a lamp current control circuit 7. The switch D2 is constituted by a diode, and the output from the phase adjusting circuit 8 is connected to the anode terminal of the switch D2 while the cathode terminal of the switch D2 is connected to the connection portion of a rectifier diode D1 and an input resistor R3 as an inverting input terminal of an operational amplifier 7*a*.

In the discharge lamp lighting apparatus 20 according to the second embodiment, the switch Q6 turns on when the output signal from the phase adjusting circuit 8 is at a high level, and turns off when the output signal is at a low level, whereby the burst mode dimming method performed in the first embodiment above is duly performed.

Obviously, many modifications and variations of the present invention are possible in light of the above teachings. Thus, it is to be understood that, within the scope of the appended claims, the invention may be practiced otherwise than as specifically described above.

What is claimed is:

1. A discharge lamp lighting apparatus comprising:

a first DC power supply;

a control circuit;

a step-up transformer defining a primary side and a secondary side; and switching elements connected to the DC power supply and functioning to drive the primary side of the step-up transformer by a signal from the control circuit thereby lighting at least two discharge lamps provided at the secondary side of the step-up transformer, wherein:

one terminal of the secondary side of the step-up transformer is connected, via each of at least two variable inductance elements, to one terminal of each of the discharge lamps, and the other terminal of the secondary side of the step-up transformer is grounded;

at least two series resonant circuits are each formed by a leakage inductance of the step-up transformer, an inductance of each of the at least two variable inductance elements, and capacitors provided between each variable inductance element and each discharge lamp;

at least two lamp current detecting units are each provided at the other terminal of each discharge lamp, and a signal of each of the at least two lamp current detecting units is connected to each of at least two lamp current control circuits;

a phase adjusting circuit is connected to at least two switches each of which is connected to a connecting node between each lamp current detecting unit and each lamp current control circuit;

each of the at least two switches is turned on and off according to an output signal from the phase adjusting circuit; and an output signal sent from each lamp current control circuit and having a phase shifted from others is connected to each of the at least two variable inductance elements so as to vary the inductance of each variable inductance element, whereby a lamp current flowing through each discharge lamp is controlled.

2. A discharge lamp lighting apparatus according to claim 1, wherein the discharge lamp lighting apparatus is incorporated in a backlight device for a liquid crystal display apparatus.

3. A discharge lamp lighting apparatus according to claim 1, wherein the output signal from the phase adjusting circuit has two different voltage levels which are low and high levels.

4. A discharge lamp lighting apparatus according to claim 1, further comprising a second DC power supply, wherein each of the at least two switches is constituted by a transistor, whose emitter terminal is connected to the connecting node between each lamp current detecting unit and each lamp current control circuit, whose collector terminal is connected to the second DC power supply, and whose base terminal is connected to the phase adjusting circuit, and wherein each of the at least two switches intermittently interrupts the second DC power supply connected to the collector terminal of the transistor according to the output signal sent from the phase adjusting circuit to the base terminal.

5. A discharge lamp lighting apparatus according to claim 1, wherein each of the at least two switches is constituted by a diode whose cathode terminal is connected to the connecting node between each lamp current detecting unit and each lamp current control circuit, and whose anode terminal is connected to the phase adjusting circuit.

6. A discharge lamp lighting apparatus according to claim 1, wherein each of the variable inductance elements constitutes a transformer, and a snubber circuit is connected to both terminals of a control winding of the transformer.

7. A discharge lamp lighting apparatus according to claim 6, wherein the discharge lamp lighting apparatus is incorporated in a backlight device for a liquid crystal display apparatus.

8. A discharge lamp lighting apparatus according to claim 1, wherein each of the lamp current control circuits includes an operational amplifier and a transistor, a signal from each of the lamp current detecting units and a reference voltage are inputted to the operational amplifier, an output of the operational amplifier is connected to a base terminal of the transistor, and a collector terminal of the transistor is connected to each of the variable inductance elements thereby varying the inductance of each variable inductance element.

9. A discharge lamp lighting apparatus according to claim 8, wherein each of the variable inductance elements constitutes a transformer, and a snubber circuit is connected to both terminals of a control winding of the transformer.

10. A discharge lamp lighting apparatus according to claim 8, wherein the discharge lamp lighting apparatus is incorporated in a backlight device for a liquid crystal display apparatus.

* * * * *